US011247835B2

(12) United States Patent
Davis

(10) Patent No.: US 11,247,835 B2
(45) Date of Patent: Feb. 15, 2022

(54) COLLECTION AND FEEDING BOTTLE CONTAINER

(71) Applicant: NeoMed, Inc., Woodstock, GA (US)

(72) Inventor: Benjamin M. Davis, Woodstock, GA (US)

(73) Assignee: NeoMed, Inc., Woodstock, GA (US)

( * ) Notice: Subject to any disclaimer, the term of this patent is extended or adjusted under 35 U.S.C. 154(b) by 29 days.

(21) Appl. No.: 16/378,008

(22) Filed: Apr. 8, 2019

(65) Prior Publication Data

US 2020/0317424 A1 Oct. 8, 2020

(51) Int. Cl.

| | |
|---|---|
| ***B65D 81/38*** | (2006.01) |
| ***A61J 9/06*** | (2006.01) |
| ***B65D 77/00*** | (2006.01) |
| ***B65D 51/24*** | (2006.01) |
| ***B65D 43/02*** | (2006.01) |

(52) U.S. Cl.

CPC ..... *B65D 81/3813* (2013.01); *A61J 9/06* (2013.01); *B65D 43/0202* (2013.01); *B65D 51/242* (2013.01); *B65D 77/003* (2013.01)

(58) Field of Classification Search

CPC ..... B65D 81/3813; B65D 51/242; B65D 43/0202; B65D 77/003; A61J 9/06

See application file for complete search history.

(56) References Cited

U.S. PATENT DOCUMENTS

| | | | | | |
|---|---|---|---|---|---|
| 1,886,879 | A | * | 11/1932 | Gross | B65D 5/3664 229/172 |
| 2,555,788 | A | * | 6/1951 | Donaldson | A45C 11/20 206/545 |
| 3,864,200 | A | | 2/1975 | Marshall | |
| 4,292,817 | A | * | 10/1981 | Loucks | A47J 41/00 62/372 |
| 4,796,758 | A | | 1/1989 | Hauk | |
| 4,828,894 | A | | 5/1989 | Taylor | |
| 4,877,128 | A | | 10/1989 | Strickland | |
| 4,941,573 | A | * | 7/1990 | Fuerstman | G09F 3/00 206/150 |
| 5,042,713 | A | * | 8/1991 | Stafford | B65D 5/32 229/117.02 |
| 5,190,213 | A | | 3/1993 | Horwitz | |

(Continued)

FOREIGN PATENT DOCUMENTS

| | | | |
|---|---|---|---|
| JP | 2006345965 | A | * 12/2006 |
| JP | 2014133580 | A | * 7/2014 |

*Primary Examiner* — Emmanuel E Duke

(74) *Attorney, Agent, or Firm* — Dority & Manning, P.A.

(57) ABSTRACT

A cooler box or container for containing a one or more bottles for storing human breast milk or infant formula. The container includes four sidewalls and a floor defining an internal volume, and a closure is configured to enclose the internal volume and prevent or provide access thereto. The container is size and shaped for fitting in a stacked arrangement within a refrigerator or freezer, and is easily transportable while keeping the internal volume at a low temperature to prevent the breast milk within the one or more bottles from spoiling. In example embodiments, the container 10 provides for multiple functions throughout its usable life such as functioning as a shipping box or container, a user transport device, and a storage bin in hospital or medical facility refrigerator.

15 Claims, 8 Drawing Sheets

(56) References Cited

U.S. PATENT DOCUMENTS

| | | | | |
|---|---|---|---|---|
| 5,501,758 | A * | 3/1996 | Nitardy | B65D 5/20 156/198 |
| 5,558,214 | A * | 9/1996 | Brundidge | A45C 13/02 206/162 |
| 6,609,392 | B1 * | 8/2003 | Brown | A61J 1/165 220/512 |
| 6,705,108 | B2 | 3/2004 | Defelice et al. | |
| 6,986,457 | B2 | 1/2006 | O'Connell et al. | |
| 9,403,619 | B2 | 8/2016 | Deutschle et al. | |
| 9,630,739 | B2 | 4/2017 | McMahon et al. | |
| 2005/0150244 | A1 * | 7/2005 | Hillmann | B65D 81/386 62/371 |
| 2006/0157547 | A1 | 7/2006 | O'Connell et al. | |
| 2008/0173703 | A1 * | 7/2008 | Westerman | B65D 5/6697 229/117.01 |
| 2009/0278009 | A1 * | 11/2009 | Nono | A47B 57/583 248/244 |
| 2010/0199711 | A1 * | 8/2010 | Smith | B67D 3/0009 62/457.4 |
| 2013/0313145 | A1 * | 11/2013 | Gilfert | B65B 21/24 206/433 |
| 2014/0175094 | A1 | 6/2014 | Spennacchio et al. | |
| 2015/0034657 | A1 * | 2/2015 | Lim | B65D 65/44 220/592.2 |
| 2017/0023546 | A1 * | 1/2017 | Holmes | A61B 5/150755 |
| 2018/0134442 | A1 * | 5/2018 | Yuasa | B65D 5/6655 |

* cited by examiner

COLLECTION AND FEEDING BOTTLE CONTAINER

CROSS-REFERENCE TO RELATED APPLICATIONS

This application claims priority to U.S. Application No. 62/658,209 filed on Apr. 16, 2018, which is hereby incorporated by reference.

TECHNICAL FIELD

The present invention relates generally to the field of storing and containing components such as containers, and more particularly to a portable container or containment device for containing a plurality of containers or bottles.

BACKGROUND

Coolers are commonly used to store food and beverage items that must be kept at low temperatures to prevent spoilage. Coolers are available in various sizes and shapes from the large hard-sided insulated chests to the individual soft-sided lunch sacks. These coolers are designed for the sole purpose of keeping perishable foodstuffs cold, and for example, to provide a container that is generally capable of being easily transportable. Coolers generally have walls defining an interior cavity into which the foodstuff is placed. The walls are usually made of or contain an insulating material such as foam or air.

Specific concerns occur when transporting human breast milk or infant formula between hospital visits and the mother's home, and during storage and use at the hospital. For example, in most cases, at the hospital and with the child feeding regularly, not all of the human breast milk is needed at once, and thus the cooler must be substantially insulated to keep the breast milk cool or the cooler (with the breast milk contained therein) must be kept at a low temperature to keep the breast milk from spoiling.

Typically, known coolers are either small, compact and lack sufficient insulation, or they are substantially large and bulky and generally have sufficient insulation to keep the breast milk at a low temperature. Thus, coolers capable of fitting within a refrigerator or within another cooling device (e.g., small and compact) generally lack the insulation or thermal capabilities to maintain the breast milk at a low temperature during transportation. And, in contrast, larger bulky coolers can generally maintain the breast milk at a lower temperature (for a longer time compared to the small and compact coolers) are substantially too large for fitting within a refrigerator or other cooler.

Needs exist for improved containers and coolers for containing and transporting human breast milk or infant formula. It is to the provision of a collection and feeding bottle container meeting these and other needs that the present invention is primarily directed.

SUMMARY

In example embodiments, the present invention provides a cooler box or container for containing a one or more bottles for storing human breast milk or infant formula. The container includes four sidewalls and a floor defining an internal volume, and the closure is configured to enclose the internal volume and prevent access thereto. The container is sized and shaped for fitting in a stacked arrangement within a refrigerator or freezer, and is easily transportable while keeping the internal volume at a low temperature to prevent the breast milk within the one or more bottles from spoiling.

In one aspect, the present invention relates to a container for containing one or more bottles including a pair of oppositely-positioned first sidewall panels, a pair of oppositely-positioned second sidewall panels, and a floor portion connected to the first and second pair of sidewall panels to define an internal volume.

In example embodiments, the one or more bottles are configured to occupy at least a portion of the internal volume, and wherein the container is generally configured for ease of portability and containment within a refrigerator. In example embodiments, the container further includes a lid for placement atop the first and second pair of sidewalls. In example embodiments, at least one of the panels includes a corrugated material. In example embodiments, the corrugated material includes first and second opposing surfaces and a plurality of interconnected webs defining a plurality of generally parallel and spaced elongated cavities therebetween. In example embodiments, at least one of the elongate cavities can be filled with water. In example embodiments, the elongate cavity is generally sealed at the ends thereof so as to contain the water therein. In example embodiments, the corrugated material is a food grade plastic.

In another aspect, the present invention relates to a container having an internal volume configured for containing at least one bottle. In example embodiments, the container is capable of being (1) shipped with one or more bottles therein to a hospital or residence, (2) acting as a cooler to maintain the one or more bottles therein at a cool temperature, (3) portable for easily transporting between at least two different geographical locations, (4) sized and shaped for fitting and stackable arrangement within a refrigerator or cooler, and (5) disposable and intended to be disposed or recycled after its use by a first user.

In example embodiments, the container further includes an outer protective layer, wrapping, sheet and/or film for protecting the container during shipping. In some example embodiments, the container includes at least one layer of packaging for protecting the container during shipment.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

Figure 1:
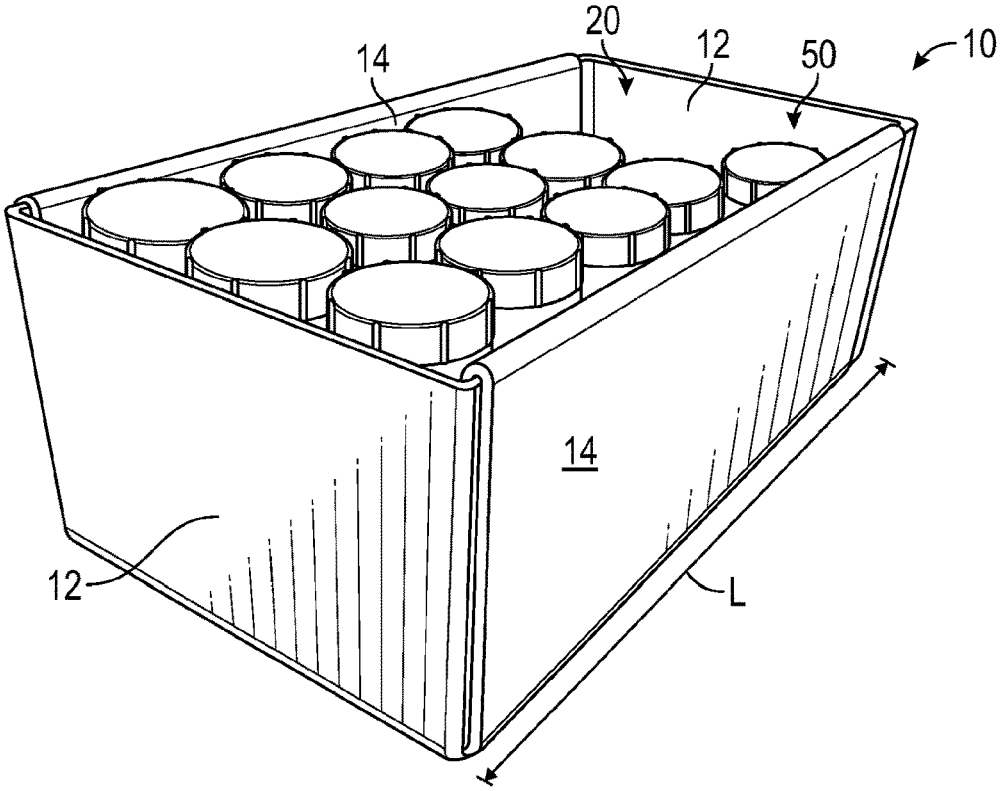
FIG. 1 is a perspective view of a container having one or more bottles contained therein according to an example embodiment of the present invention.
Figure 9:
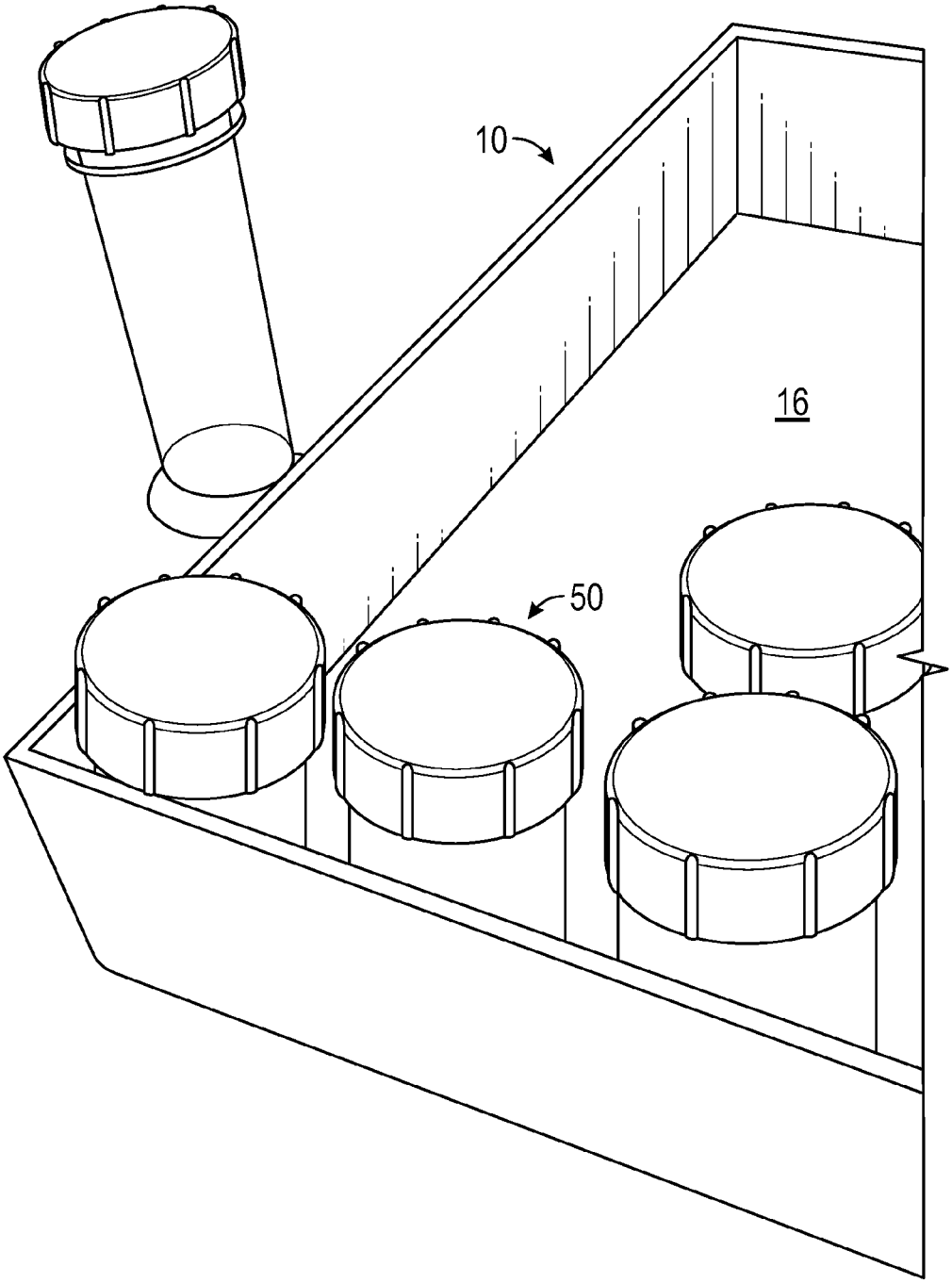

FIG. 9 shows a partial perspective view of the container of FIG. 1.

Figure 10:
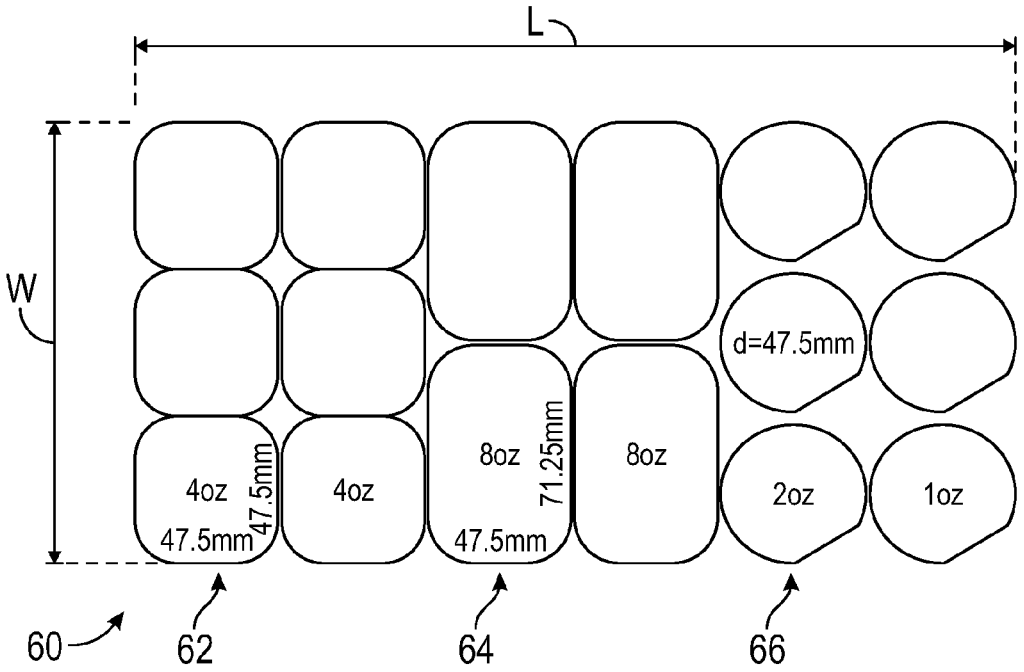

FIG. 10 shows a top plan view of a bottle arrangement according to an example embodiment of the present invention.

Figure 11:
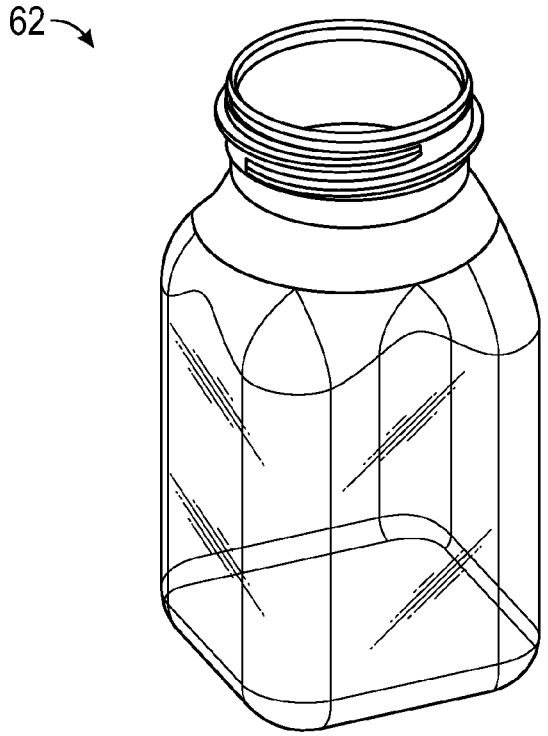

FIG. 11 shows a perspective view of one of the bottles of FIG. 10.

Figure 12:
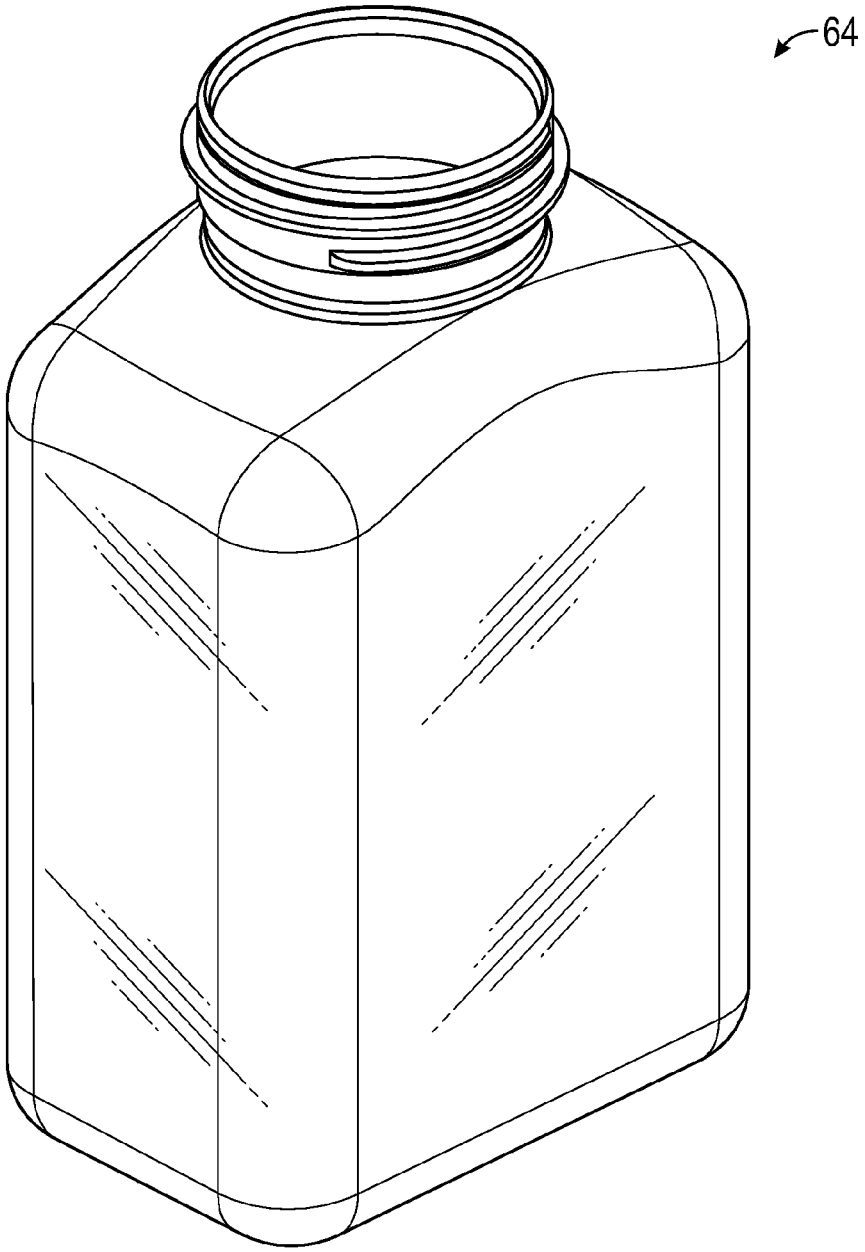

FIG. 12 shows a perspective view of one of the bottles of FIG. 10.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-9 show a cooler box or container 10 for containing a plurality of bottles or containers 50, for example, bottles or containers 50 comprising human breast milk or infant formula. In example embodiments, the container 10 generally comprises a first pair of oppositely-positioned sidewall panels 12, a second pair of oppositely-positioned sidewall panels 14, and a base or floor panel 16 connected to the first and second pair of sidewall panels to define an internal volume 20. In example embodiments, the one or more bottles 50 are configured to occupy at least a portion of the internal volume 20, for example, wherein the panels 12, 14 and floor 16 generally provide for containment of the one or more bottles 50 therein. In example embodiments, the container 10 is generally configured for ease of portability and containment within a refrigerator, for example, to provide a container which can be transported between the mother's home residence and the hospital or medical facility, and is preferably compatible for storage within a refrigerator at both the mother's home and at the hospital. In example embodiments, the sidewall panels 12, 14 and floor 16 can comprise insulation or otherwise be configured to retain the one or more bottles 50 comprising breast milk at a low temperature, for example, such that the breast milk does not spoil. In preferred example embodiments, the container as described herein can preferably be stacked and fitted in an arranged manner in the refrigerator/freezer.

Figure 2:
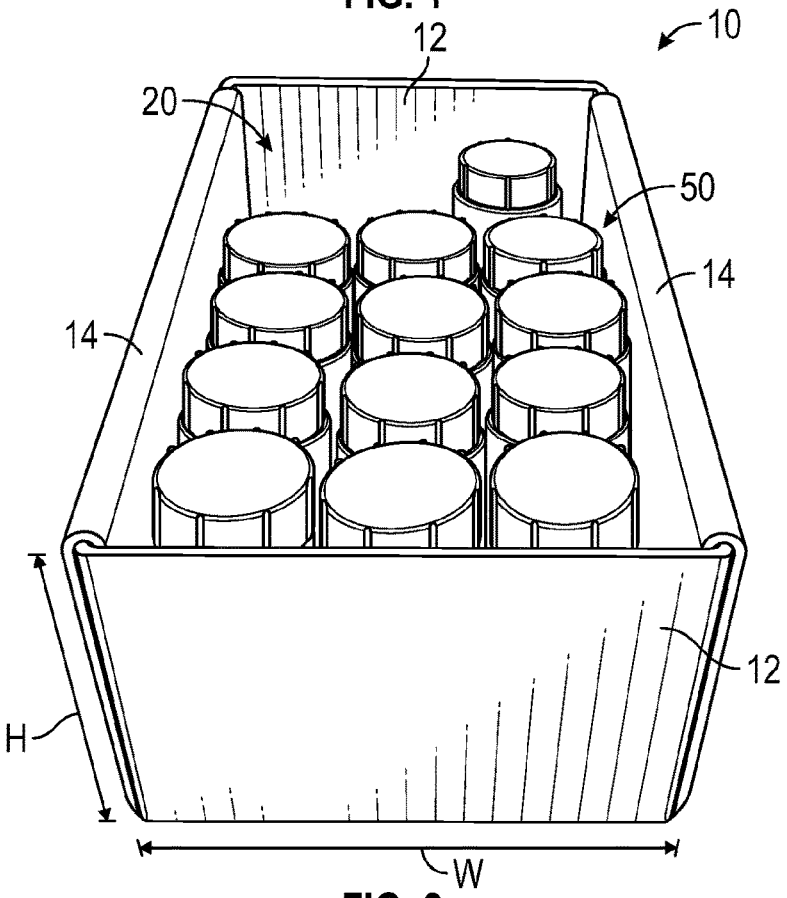
FIG. 2 is an end perspective view of the container of FIG. 1.
Figure 3:
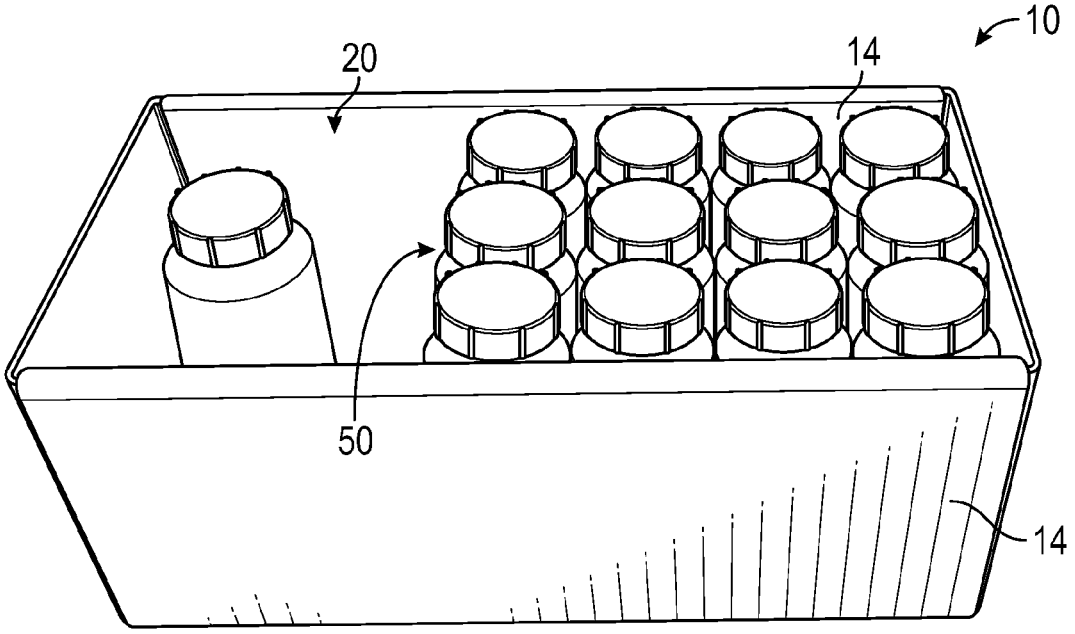
FIGS. 3-4 show side perspective views of the container of FIG. 1.

As depicted in FIGS. 1-2, the container 10 defines a length L, a width W, and a height H. In example embodiments, the length L, width W and height H can be chosen as desired, for example, so as to be sized such that the container 10 is both portable or transportable and compact for fitting within a refrigerator or cooler. According to example embodiments, the length L is generally between about 10-14 inches, the width W is generally between about 4.5-8 inches, and the height H is generally between about 3-6 inches. According to one example embodiment, the length L is generally between about 10.5-13 inches, the width W is generally between about 5-7 inches, and the height H is generally between about 3-4.5 inches. In example embodiments, the dimensions between the inner surfaces of the panels 12, 14 and floor 16 are generally similar to the dimensions of the length L, width W and height H as described above.

According to example embodiments, the panels 12, 14 and floor 16 comprise an extruded thinwall plastic-sheet material, for example, which is generally commonly referred to as corrugated plastic (or other names such as corriboard, or under the tradenames of Polyflute, Coroplast, FlutePlast, IntePro, Proplex, Correx, Twinplast, Corriflute or Corflute). In example embodiments, the corrugated plastic is formed from a food safe plastic material such as polyethylene terephthalate (PTE), polypropylene (PP), high-density polyethylene (HDPE), low-density polyethylene (LDPE) or polycarbonate (PC). In one example embodiment, a combination of one or more food safe materials can be combined to form the corrugated material. Optionally, other plastics, foams, insulators, cardboard, synthetic materials, natural materials and/or combinations thereof can be provided for forming the corrugated panels (e.g., the panels 12, 14 and floor 16). In alternate embodiments, one or more of the panels and/or floor can be constructed from one or more desirable materials (e.g., plastic, foam or other thermal insulator, cardboard, vinyl, synthetic materials, natural materials and/or combinations thereof) as desired.

Figure 4:
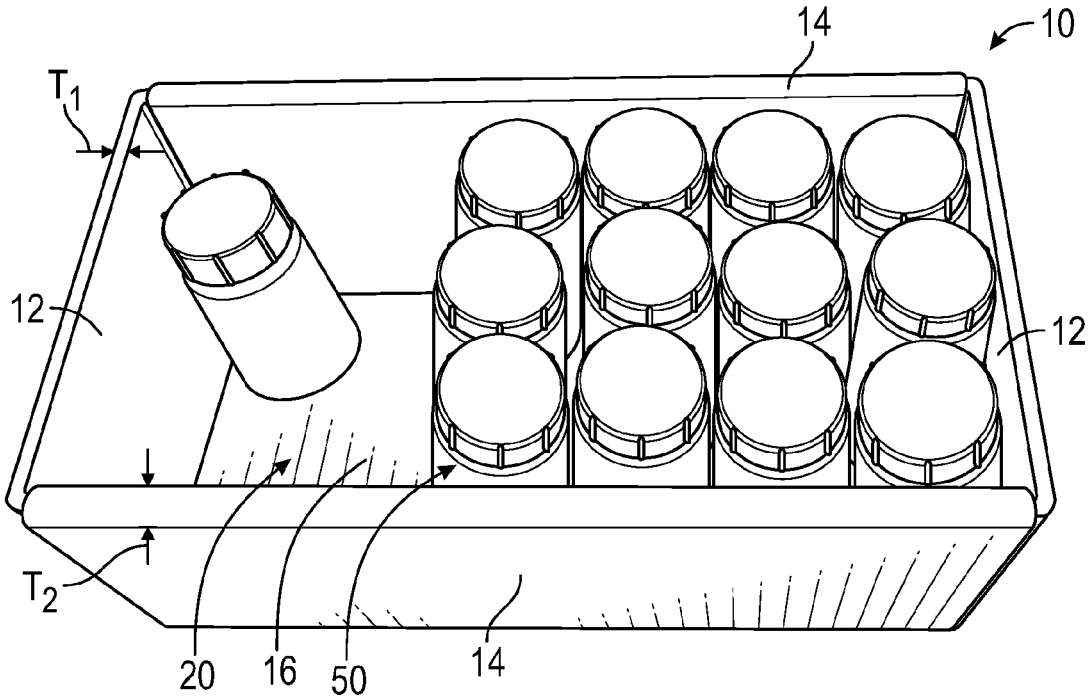
Figure 5:
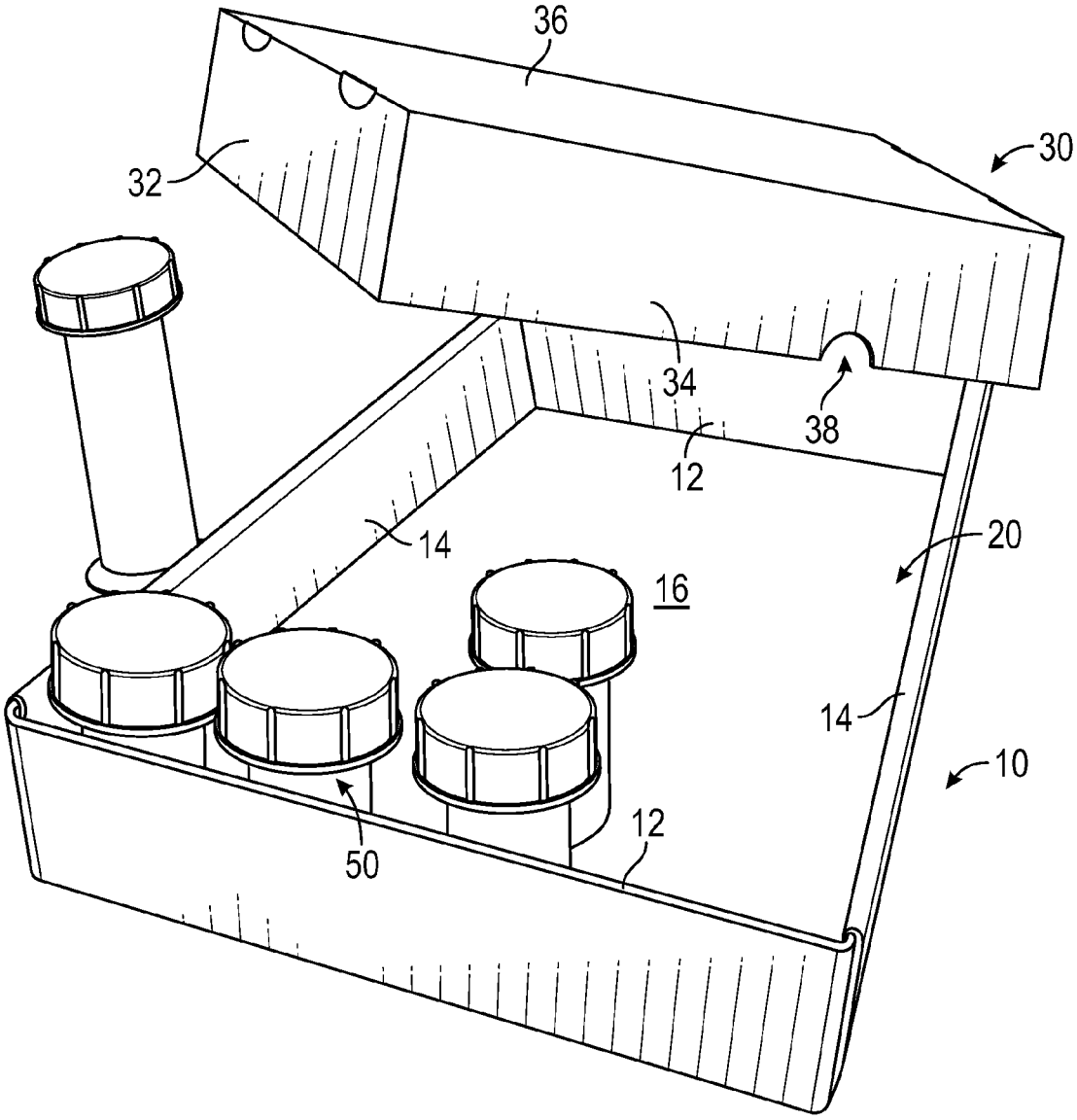
FIGS. 5-6 show perspective view of the container of FIG. 1, and showing a lid or closure being generally removed from the container for accessing on or more of the containers.
Figure 6:
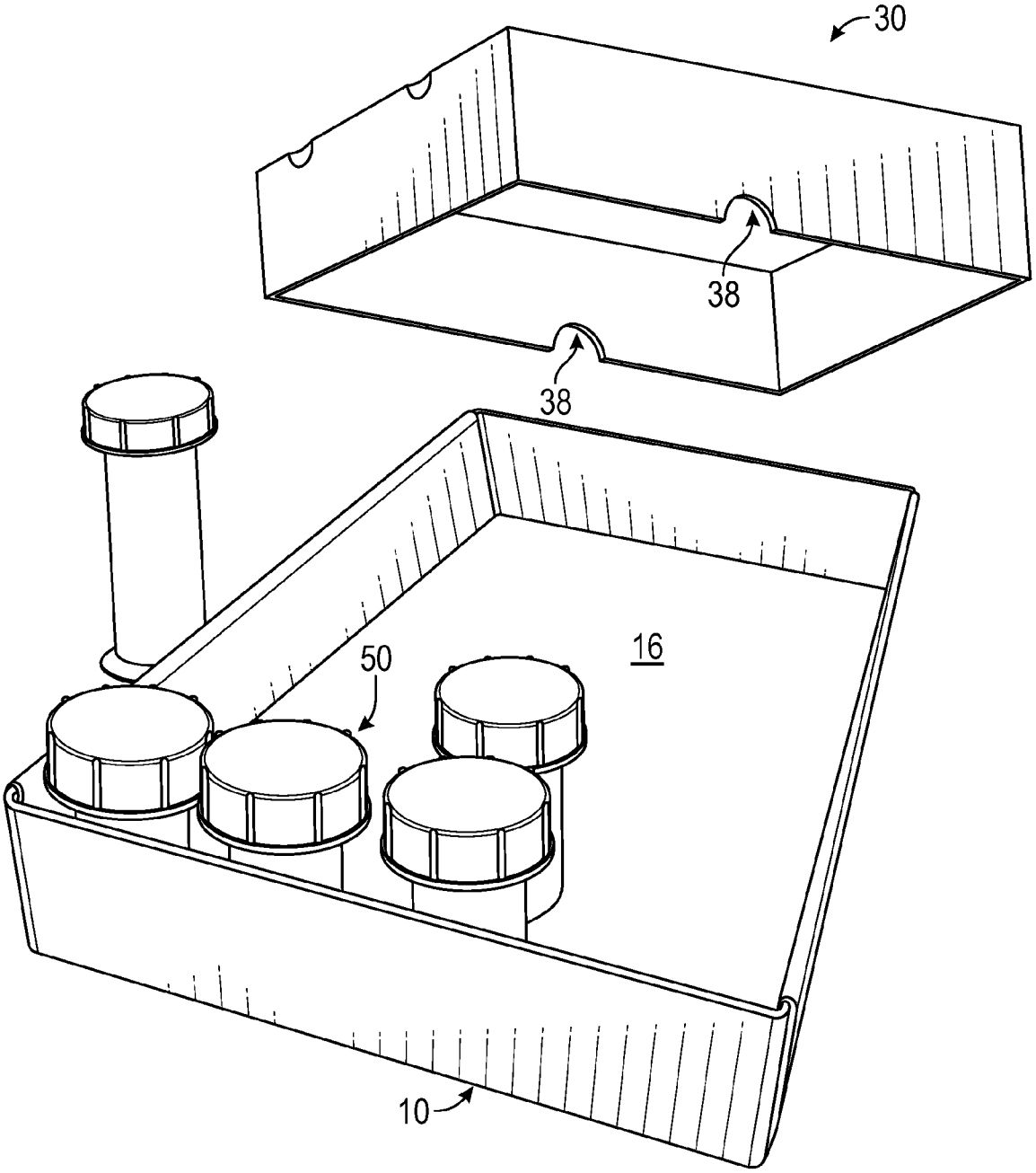

As depicted in FIG. 4, the panels 12 comprise a thickness T1 and the panels 14 comprise a thickness T2. According to one example embodiments, the thickness of the corrugated plastic material is generally substantially similar to the thickness T1, for example, between about 0.180-0.250 inches. Thus, the thickness of a single panel of the corrugated plastic material is generally between about 0.180-0.250 inches. In example embodiments, the corrugated plastic material comprises first and second opposing surfaces and a plurality of interconnected webs defining a plurality of generally parallel and spaced elongated cavities therebetween. U.S. Published Patent Application No. 2015/0034657 discloses a food grade container comprising a corrugated material defining a plurality of spaced elongated cavities, the entirety of which is incorporated herein by reference.

In example embodiments, the thickness T2 is generally about three times the thickness T1, for example, wherein constructing the container from a collapsed configuration is such that the pair of oppositely-positioned sidewall panels 14 are generally thicker than the sidewall panels 12. In alternate example embodiments, the panels 12, 14 and/or floor 16 can preferably be dimensioned as desired. As such, the internal volume that is defined by the panels 12, 14 and floor 16 can preferably define a volume (and two dimensional area) such that a plurality of bottles 50 can be fitted therein, for example, and generally remain positioned and contained therein until it is desired to remove for collection or feeding.

Figure 7:
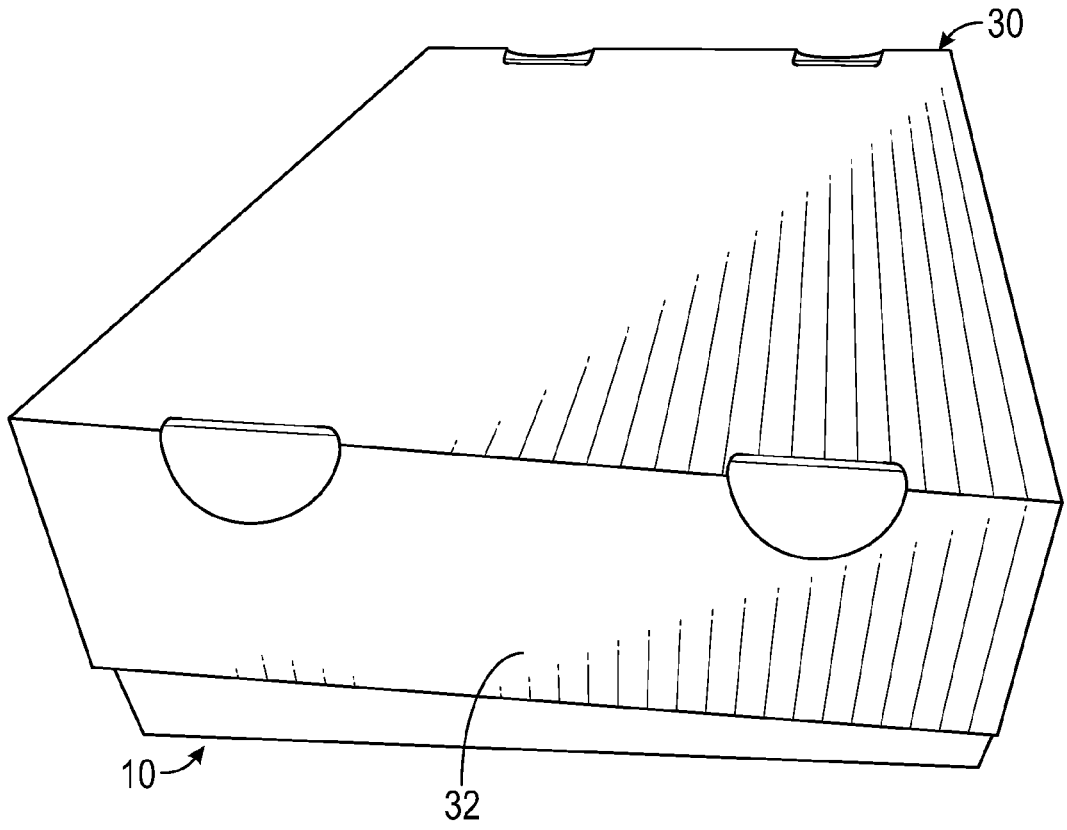
FIGS. 7-8 show end and side perspective view of the container of FIG. 1, showing the lid or closure of FIGS. 5-6 being connected to the container such that the lid generally entirely covers the one or more bottles contained therein.
Figure 8:
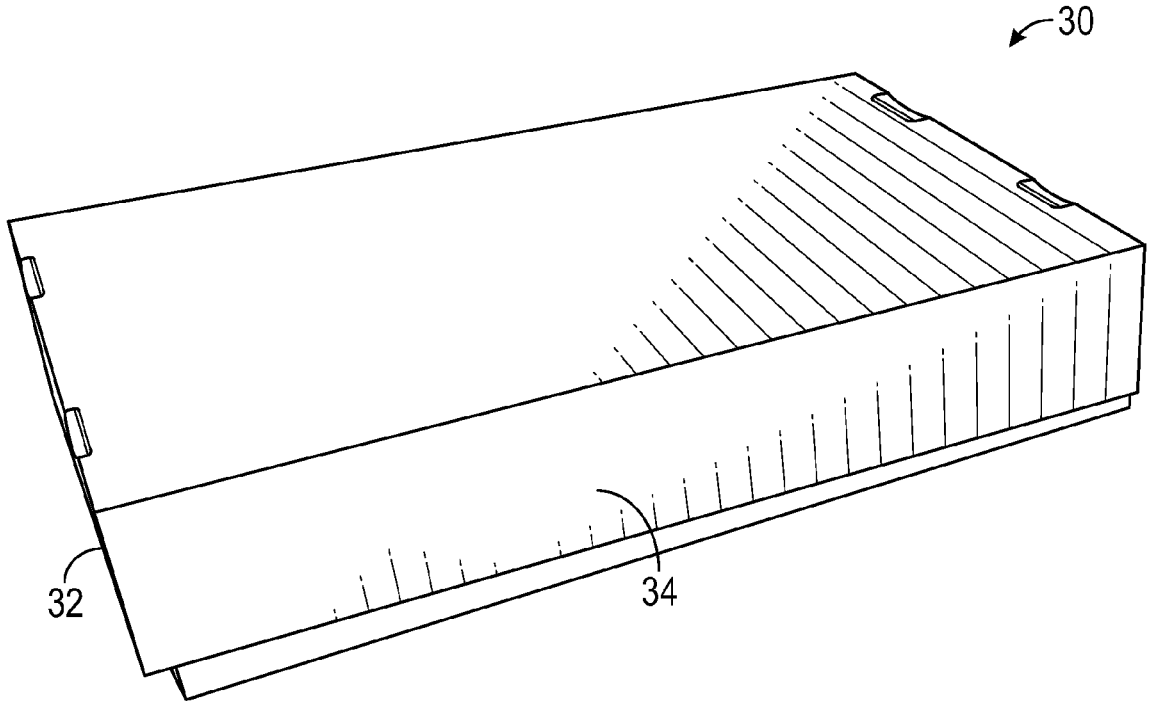

As depicted in FIGS. 5-8, a lid or closure 30 can be provided for fitting engagement with the container 10 such that the internal volume 20 is generally entirely covered by the lid, for example, to conceal and protect the bottles 50 to reduce the likelihood of contamination. In example embodiments, the closure 30 comprises a first pair of oppositely-positioned sidewall panels 32, a second pair of oppositely-positioned sidewall panels 34, and a cover panel 36 connected to the first and second pair of sidewall panels. As shown in FIGS. 7-8, the closure 30 is configured for fitting with the container 10 to cover or generally enclose the internal volume 20. In example embodiments, the sidewall panels 32 are configured for fitting with the panels 12 and the sidewall panels 34 are configured for fitting with the panels 14, for example, such that the closure generally slidingly engages with the container 10 and with the outer surfaces of the panels 12, 14 generally engaging with inner surfaces of the sidewall panels 32, 34. In some example embodiments, one or more cutouts 38 can be provided for assisting a user or operator in removing the closure 30 from the container 10, for example, to access the internal volume 20 and the one or more bottles 50 contained therein. In example embodiments, the closure 30 can be a separate member or can be integral with the container 10. In some example embodiments, the closure 30 can be configured for sliding engagement relative to the closure such that the same can move between a closed configuration and an open configuration. In other example embodiments, the closure 30 can be hingedly coupled to the container 10 for pivotal movement between an open configuration and a closed configuration. In some example embodiments, one or more fasteners, clips, clasps, or other interengagement members can be provided to secure the closure in a closed configuration. According to one example embodiment, the container and closure can comprise complementary engagement members, such as a male and a female coupler, or for example, a magnetic material and a ferromagnetic material or another magnetic material.

FIG. 10 shows a bottle arrangement assembly 60, for example, which generally defines a footprint of one or more bottles 62, 64, 66 being contained within a container defining an area (e.g., L×W). In example embodiments, the area of the container can be configured such that a plurality of bottles can be arranged along the floor and within the sidewall panels. For example, according to example embodiments, the area of the floor (and defined by the contained volume) is generally between about 15-18 square inches ($in^2$). According to one example embodiment, the length is about 285 millimeters (11.221 inches) and the width W is about 142.5 millimeters (5.610 inches), and thus the area is about 16.831 square inches.

In example embodiments, the container 10 (and bottles 62, 64, 66) can be configured to accommodate a plurality of variations, for example, to accommodate bottles of multiple containment volumes and geometries while generally comprising the same footprint such that their position and arrangement within the container generally remains the same. In example embodiments and as depicted in FIG. 10, the bottle arrangement assembly 60 comprises about six 4 ounce bottles 62, about four 8 ounce bottles 64, and about six 2 ounce bottles 66. In example embodiments, for example, with the area of the container remaining the same, a plurality of four ounce, eight ounce and two ounce bottles can be contained therein and generally remain constrained such that their position and orientation generally remain the same. For example, according to one example embodiment, the container 10 could contain about eighteen 2 or 4 ounce bottles 62, 64, or for example, contain about twelve 8 ounce bottles. In other example embodiments, the number and containment volume of the bottles can be preferably chosen as desired. FIG. 11 shows the 4 ounce bottle 62 in greater detail and FIG. 12 shows the 8 ounce bottle in greater detail.

According to example embodiments of the present invention, one or more of the bottles within the container can be filled with a fluid such as water, for example, so as to provide one or more cooling components within the cooler so as to keep the bottles containing breast milk at a low temperature. In example embodiments, the one or more bottles comprising the water can be frozen and placed within the container during use or transport, for example, at any point throughout its use where there is a concern of the breast milk becoming spoiled. According to one example embodiment, the one or more bottles that are configured for being filled with water can comprise a different colored cap or closure as compared to the bottles containing breast milk. Thus, a user intending to remove a bottle for feeding would immediately realize which bottles within the container are filled with breast milk for feeding.

According to another example embodiment, one or more of the elongate cavities of the corrugated panel can be filled with an insulation or fluid barrier, for example, so as to provide an effective barrier to substantially prevent or reduce the transfer of heat to the one or more bottles within the container. In one example embodiment, one or more of the elongate cavities are filled with a liquid such as water so as to prolong maintaining the contained volume at a low temperature. In some example embodiments, the container comprising the one or more elongate cavities filled with liquid can be frozen or substantially cooled so as to keep the panels and floor at a low temperature, thereby maintaining the internal volume at a low temperature. In alternate example embodiments, other materials, insulators, etc. can be filled within one or more of the elongate cavities as desired. Furthermore, the closure 30 can optionally comprise the corrugated material comprising one or more elongate cavities, which can optionally be filled with one or more materials as described above. According to some example embodiments, one or more of the elongate cavities can be filled with phase change materials, for example, so as to prolong the cooling and maintain the internal volume at a low temperature.

According to example embodiments, the container and closure of the present invention can preferably be sized and shaped as desired, and can be constructed in a plurality of different ways. According to one example embodiment, a substantially integral panel can be folded one or more times to define the panels and floor of the container, and similarly an integral panel can be folded one or more times to define the sidewall panels and cover panel. Optionally, one or more separate panels or pieces can be coupled together as desired to form the container and closure.

As depicted in the figures, the container and closure are separate pieces. Optionally, the container and closure can be configured to generally remain coupled together while still providing access to the internal volume. For example, the closure can be hinged to pivot relative to the container between an open position and a closed position, or for example, the closure member can generally traverse or move generally axially relative to the container between an open position and a closed position. In other example embodiments, the closure can be configured as desired so as to either permit access to the internal volume for accessing the one or more bottles, or prevent access thereto and generally provide an insulative barrier to keep the internal volume at a low temperature. In some example embodiments, one or more closures, clips, clasps, hook and loop fasteners, magnets, or other couplings can be provided so as to generally prevent unintended opening of the closure. For example, in some example embodiments, a user must generally decouple or unfasten the coupling to allow the closure to open.

In some example embodiments, one or more components can be implemented within the container to facilitate a user in arranging the bottles to allow a FIFO-type (first-in, first-out) process such that the first filled breast milk bottle inserted within the container will be the first filled breast milk bottle removed from the container for use. Optionally, according to some example embodiments, one or more handles can be provided to facilitate a user in handling and grasping the container. Preferably, the container is generally sealed or coated such that a spillage or leak therein (e.g., loose milk therein) is prevented from leaking from the container. According to another example embodiment, one or more windows can be provided for viewing at least a portion of the internal volume (and one or more bottles contained therein), and/or a portion of the container or closure can comprise a portion thereof for labeling or assigning the container, for example, like a name tag or other identification tag. In other example embodiments, an RFID chip or sensor can be implemented with the container, closure and/or individual bottles so as to provide a real-time tracking system for monitoring the container's location and use of the breast milk for feeding.

According to example embodiments of the present invention, the container 10 of the presently claimed invention can provide for multiple functions throughout its usable life. For example, according to some example embodiments, the present container 10 can function as a shipping box or container, a user transport device (for transporting between at least two geographical locations) and a storage bin in the hospital or medical facility refrigerator, cooler or freezer.

In example embodiments, the container 10 can at least initially act or function as a shipping container so as to deliver or provide the mother or user with one or more bottles 50 for collecting and storing the colostrum or breast milk therein. For example, according to example embodiments, the container 10 comprises a plurality of capped bottles therein, which is covered with a lid or other closure and shipped to the mother, user, hospital or medical facility. According to some example embodiments, the entire container (with the bottles therein and lid attached) is further wrapped or generally covered with a protecting layer, film or other material so as to provide a tamper-proof evident feature, and for example to generally keep contaminants and other miscellaneous debris from being exposed to the container (and bottles therein) during shipping. According to some example embodiments, the container 10 can be initially packaged within a cardboard box or other packaging for the initial shipment thereof. In some example embodiments, the packaging does not have a tamper-proof evident feature. According to yet another example embodiment, a plurality of containers 10 can be packaged within a cardboard box or other packaging, for example, for shipment to the hospital to then be distributed individually to each mother.

Once received by the mother, user, hospital or medical facility, the outer film or tamper-proof evident feature can be broken so as to access the bottles for collecting the colostrum or breast milk (or optionally the container 10 is removed from the packaging used for shipping). Once the milk is collected, the filled bottles are placed back within the container and the container is placed within a refrigerator, cooler or freezer at the hospital or medical facility and the bottles can then be removed as needed to feed the patient. Thereafter, the container can facilitate the transportation of the bottles between the mother's residence and the hospital or medical facility, for example, wherein one or more of the bottles may contain colostrum or breast milk. Thus, accordingly, the container preferably acts as a cooler so as to maintain the bottles therein at a cool temperature to prevent the colostrum or breast milk from spoiling, for example, when the container itself is not within a refrigerator, cooler or freezer. For example, once the mother and container (comprising one or more bottles of breast milk) arrives at the hospital or medical facility, the container with the bottles of breast milk contained therein is stored within the refrigerator, cooler or freezer, and can be stacked and/or conveniently arranged along with other mother's containers.

Furthermore, the container is preferably unique to each mother or user, for example, such that the bottles and container remain paired or together throughout their useful life, for example, to prevent bottles containing breast milk to be stored within a community or reusable container or bin within the hospital refrigerator, cooler or freezer. In example embodiments, the container of the present invention is disposable and is not intended to be washed and reused by the hospital, another mother or patient. Thus, as clearly described herein, the container of the present invention can provide for multiple functions throughout its usable life such as acting as a shipping box or container, a portable cooler, a user transport device, and a storage bin in the hospital or medical facility (or at the mother's home or residence).

According to a preferred embodiment, the plurality of bottles comprise one of a plurality of different visual indicia on each bottle, the visual indicia being configured to present a bottle contents identification system. The plurality of bottles comprise one of a plurality of different visual indicia on each bottle, the visual indicia being configured to present a bottle contents identification system. The plurality of bottles comprise a removable cap comprising the different visual indicia. The color coded caps allow for visualization of the bin contents from the front without having to remove the bin from the freezer/fridge (keep in mind that many/most of these freezers/fridges in the hospital have glass doors so a bin like this with color coded caps allows for the clinician to see what's going on without even having to open the freezer/fridge door). An example color coding system can include: Color 1=Colostrum; Color 2=Human Breast Milk; Color 3=Donor Milk; Color 4=Fortified Milk; Color 5=Foremilk; and Color 6=Hindmilk.

A breast milk management kit of parts comprising: a disposable container configured to have a shipping state, a transport state, a storage state and a dispensing state, the container comprising an internal volume defined by a rigid support floor defining a geometry, a pair of self-supporting side walls extending upwardly from the floor, and a pair of self-supporting end walls extending upwardly from the floor, the pair of self-supporting side-walls and the pair of self-supporting end walls being secured to each other; and a plurality of bottles configured for receiving a volume of breast milk, the plurality of bottles comprising dimensions within a range between a smaller first cross-sectional area and a larger second cross-sectional area, the plurality of bottles configured to retain a position and orientation with respect to the container floor geometry when the plurality of bottles are received within the container internal volume, the plurality of bottles comprise a plurality of caps each having one of a plurality of different colors configured to identify different material contents within the plurality of bottles.

While the invention has been described with reference to example embodiments, it will be understood by those skilled in the art that a variety of modifications, additions and deletions are within the scope of the invention, as defined by the following claims.

What is claimed is:

1. A breast milk management kit of parts comprising:

a disposable container configured to have a shipping state, a transport state, a storage state and a dispensing state, the container comprising an internal volume defined by a rigid support floor defining a geometry, a pair of self-supporting side walls extending upwardly from the floor, wherein each of the side walls has a thickness T2, and a pair of self-supporting end walls extending upwardly from the floor, wherein each of the end walls has a thickness T1, wherein the thickness T2 is greater than the thickness T1, wherein each of the end walls are inserted within each of the side walls such that the pair of self-supporting side-walls and the pair of self-supporting end walls are secured to each other, the pair of self-supporting side walls comprising a plurality of interconnected webs defining a plurality of generally parallel and spaced elongated cavities therebetween, the pair of self-supporting end walls comprising a plurality of interconnected webs defining a plurality of generally parallel and spaced elongated cavities therebetween, wherein the side walls, the end walls and the floor are formed from a corrugated material comprising food grade plastic; and a plurality of bottles configured for receiving a volume of breast milk, the plurality of bottles comprising multiple containment volumes, the containment volumes being in a range from two ounces to eight ounces, the plurality of bottles comprising dimensions within a range between a smaller first cross-sectional area and a larger second cross-sectional area, the plurality of bottles configured to retain a position and orientation with respect to the container floor geometry when the plurality of bottles are received within the container internal volume.

2. The breast milk management kit of parts of claim 1, wherein at least one of the pair of self-supporting side walls and the pair of self-supporting end walls comprises a top edge positioned distally away from the container floor, the top edge comprising an access opening to the plurality of generally parallel and spaced elongated cavities between the plurality of interconnected webs.

3. The breast milk management kit of parts of claim 1, wherein the generally parallel and spaced elongated cavities between the plurality of interconnected webs are configured to receive a volume of material, wherein the material is insulation or a fluid barrier.

4. The breast milk management kit of parts of claim 1, wherein the generally parallel and spaced elongated cavities between the plurality of interconnected webs are configured to receive a volume of material that maintains temperature substantially similar to the freezing point of water.

5. The breast milk management kit of parts of claim 1, further comprising a cover that removably covers the container volume, the cover comprising a plurality of interconnected webs defining a plurality of generally parallel and spaced elongated cavities therebetween.

6. The breast milk management kit of parts of claim 1, wherein the plurality of bottles comprise one of a plurality of different visual indicia on each bottle, the visual indicia being configured to present a bottle contents identification system.

7. The breast milk management kit of parts of claim 6, wherein the one of a plurality of different visual indicia comprises a plurality of different colors configured to identify different material contents within the plurality of bottles.

8. The breast milk management kit of parts of claim 7, wherein the plurality of bottles comprise a removable cap comprising the different visual indicia.

9. A breast milk management kit of parts comprising:

a disposable container configured to have a shipping state, a transport state, a storage state and a dispensing state, the container comprising an internal volume defined by a rigid support floor defining a geometry, a pair of self-supporting side walls extending upwardly from the floor, wherein each of the side walls has a thickness T2, and a pair of self-supporting end walls extending upwardly from the floor, wherein each of the end walls has a thickness T1, wherein the thickness T2 is greater than the thickness T1, wherein each of the end walls are inserted within each of the side walls such that the pair of self-supporting side-walls and the pair of self-supporting end walls are secured to each other, wherein the side walls, the end walls and the floor are formed from a corrugated material comprising food grade plastic; and a plurality of bottles configured for receiving a volume of breast milk, the plurality of bottles comprising multiple containment volumes, the containment volumes being in a range from two ounces to eight ounces, the plurality of bottles comprising dimensions within a range between a smaller first cross-sectional area and a larger second cross-sectional area, the plurality of bottles configured to retain a position and orientation with respect to the container floor geometry when the plurality of bottles are received within the container internal volume, the plurality of bottles comprise a plurality of caps each having one of a plurality of different colors configured to identify different material contents within the plurality of bottles.

10. A container for containing one or more bottles comprising:

a pair of oppositely-positioned first sidewall panels having a thickness T2;

a pair of oppositely-positioned second sidewall panels having a thickness T1 that is less than the thickness T2; and a floor portion connected to the first and second pair of sidewall panels to define an internal volume, wherein each end wall of a pair of end walls are inserted within each of the sidewalls, wherein the side walls, the end walls and the floor are formed from a corrugated material comprising food grade plastic;

further wherein the one or more bottles are configured to occupy at least a portion of the internal volume, and wherein the container is generally configured for ease of portability and containment within a refrigerator, the one or more bottles comprising multiple containment volumes, the containment volumes being in a range from two ounces to eight ounces.

11. The container of claim 10, further comprising a lid for placement atop the first and second pair of sidewalls.

12. The container of claim 10, wherein the corrugated material comprises first and second opposing surfaces and a plurality of interconnected webs defining a plurality of generally parallel and spaced elongated cavities therebetween.

13. The container of claim 12, wherein at least one of the elongate cavities can be filled with water.

14. The container of claim 13, wherein the at least one elongate cavity that can be filled with water is generally sealed at ends thereof so as to contain water therein.

15. The container of claim 10, wherein the container is capable of acting as a cooler to maintain the one or more bottles therein at a cool temperature, the container being portable for easily transporting between at least two different geographical locations, wherein the container is disposable and intended to be disposed or recycled after its use by a first user.

* * * * *